US006792869B2

(12) United States Patent
Pi

(10) Patent No.: US 6,792,869 B2
(45) Date of Patent: Sep. 21, 2004

(54) EXPANDING SOFT POINT BULLET

(75) Inventor: Peter R. Pi, Sturgis, SD (US)

(73) Assignee: Zelda, LLC, Sturgis, SD (US)

( * ) Notice: Subject to any disclaimer, the term of this patent is extended or adjusted under 35 U.S.C. 154(b) by 0 days.

(21) Appl. No.: 10/143,296

(22) Filed: May 10, 2002

(65) Prior Publication Data

US 2003/0209164 A1 Nov. 13, 2003

(51) Int. Cl.[7] ..... F42B 12/34; F42B 12/32
(52) U.S. Cl. ..... 102/510; 102/516
(58) Field of Search ..... 102/507, 508, 102/509, 510, 516, 517

(56) References Cited

U.S. PATENT DOCUMENTS

| | | | | | |
|---|---|---|---|---|---|
| 843,017 | A | * | 2/1907 | Hoxie | 102/510 |
| 896,021 | A | * | 8/1908 | Hoxie | 102/510 |
| 1,004,510 | A | * | 9/1911 | Waston | 102/508 |
| 1,155,901 | A | * | 10/1915 | Duncan | 102/508 |
| 1,493,614 | A | * | 5/1924 | Dickerman | 102/510 |
| 3,911,820 | A | | 10/1975 | Canon | |
| 3,972,286 | A | | 8/1976 | Canon | |
| 4,245,557 | A | * | 1/1981 | Knappworst et al. | 102/508 |
| 4,655,140 | A | * | 4/1987 | Schirneker | 102/508 |
| 5,454,325 | A | | 10/1995 | LeBlanc | |
| 5,760,329 | A | * | 6/1998 | Baum et al. | 102/439 |
| 5,763,819 | A | * | 6/1998 | Huffman | 102/510 |
| 6,176,186 | B1 | * | 1/2001 | Engel | 102/510 |
| 6,526,893 | B2 | * | 3/2003 | May et al. | 102/508 |
| 2003/0089264 | A1 | * | 5/2003 | Eberhart et al. | 102/510 |

FOREIGN PATENT DOCUMENTS

| | | | | | |
|---|---|---|---|---|---|
| DE | 198929 | | * | 6/1908 | 102/507 |
| EP | 636853 | A1 | * | 2/1995 | F42B/12/34 |
| GB | 0022505 | | * | 5/1907 | 102/509 |
| WO | 9402798 | A1 | * | 2/1994 | F42B/12/34 |

* cited by examiner

*Primary Examiner*—Charles T. Jordan
*Assistant Examiner*—Susan C. Alimenti
(74) *Attorney, Agent, or Firm*—Langlotz Patent Works, Inc.; Bennet K. Langlotz

(57) ABSTRACT

A bullet has a core with a leading end defining a cavity. A jacket surrounds the core and exposes the cavity. A nose element is at least partly received within the cavity. The nose element may be a plastic ball with an exposed nose surface that smoothly transitions to an adjacent portion of the jacket. The cavity may be a conically tapered cavity, and the nose element may enclose a chamber portion of the cavity. The core is formed of a ductile material, and may be a soft lead material of high purity.

14 Claims, 1 Drawing Sheet

EXPANDING SOFT POINT BULLET

FIELD OF THE INVENTION

This invention relates to firearm ammunition, and more particularly to expanding bullets.

BACKGROUND AND SUMMARY OF THE INVENTION

Firearms ammunition for self defense has traditionally employed hollow point bullets, which expand upon striking tissue. In contrast to round-nosed or ball ammunition, the expansion generates a larger wound that is more likely to rapidly incapacitate an assailant to terminate an assault. The expansion also slows the bullet more rapidly, so that it does not exit the assailant with appreciable energy. This reduces the risk that a bullet may endanger innocent people beyond the assailant, and ensures that all the bullet's kinetic energy is transferred to the targeted assailant.

While effective in many respects, hollow point bullets have several disadvantages. First, the hollow point geometry can generate feeding problems in a self loading firearm. Such bullets have a forward end with a circular rim having a relatively sharp edge that surrounds the hollow cavity in the bullet nose. This leading edge provides a very small point of contact with surfaces over which it must slide during feeding and loading (e.g. feed ramps). This generates higher pressures at the contact point, and can lead to failures to feed if there are irregularities on the surfaces over which the bullet nose must slide.

A second disadvantage of hollow point bullets is that they have a lower ballistic coefficient compared to ball ammunition, because the unstreamlined hollow point generates more air resistance during flight. This reduces the energy of the bullet down range, reducing the incapacitating effect compared to higher velocity strikes. In addition, for longer distance shots, the velocity reduction leads to more bullet drop due to the effects of gravity during its flight, requiring greater elevation compensation by the shooter, and potentially introducing inaccuracies.

A third disadvantage of hollow point bullets is their performance on heavily clothed targets, or those behind light cover. Upon striking an assailant wearing heavy layers of denim and or leather, the hollow point cavity may be clogged with pieces of the material, and thus perform more like a ball bullet upon reaching tissue, and fail to expand adequately. In other instances, the clothing layers may generate premature expansion that transfers excessive energy to the clothing. Consequently, the bullet may not adequately penetrate tissue with adequate energy. Similarly, a hollow point bullet that expands upon contact with light cover material such as automotive panels or glass may undesirably lose excessive energy due to premature expansion before striking the tissue of the target.

The present invention overcomes the limitations of the prior art by providing a bullet. The bullet has a core with a leading end defining a cavity. A jacket surrounds the core and exposes the cavity. A nose element is at least partly received within the cavity. The nose element may be a plastic ball with an exposed nose surface that smoothly transitions to an adjacent portion of the jacket. The cavity may be a conically tapered cavity, and the nose element may enclose a chamber portion of the cavity. The core is formed of a ductile material, and may be a soft lead material of high purity.

DETAILED DESCRIPTION OF A PREFERRED EMBODIMENT

Figure 1:
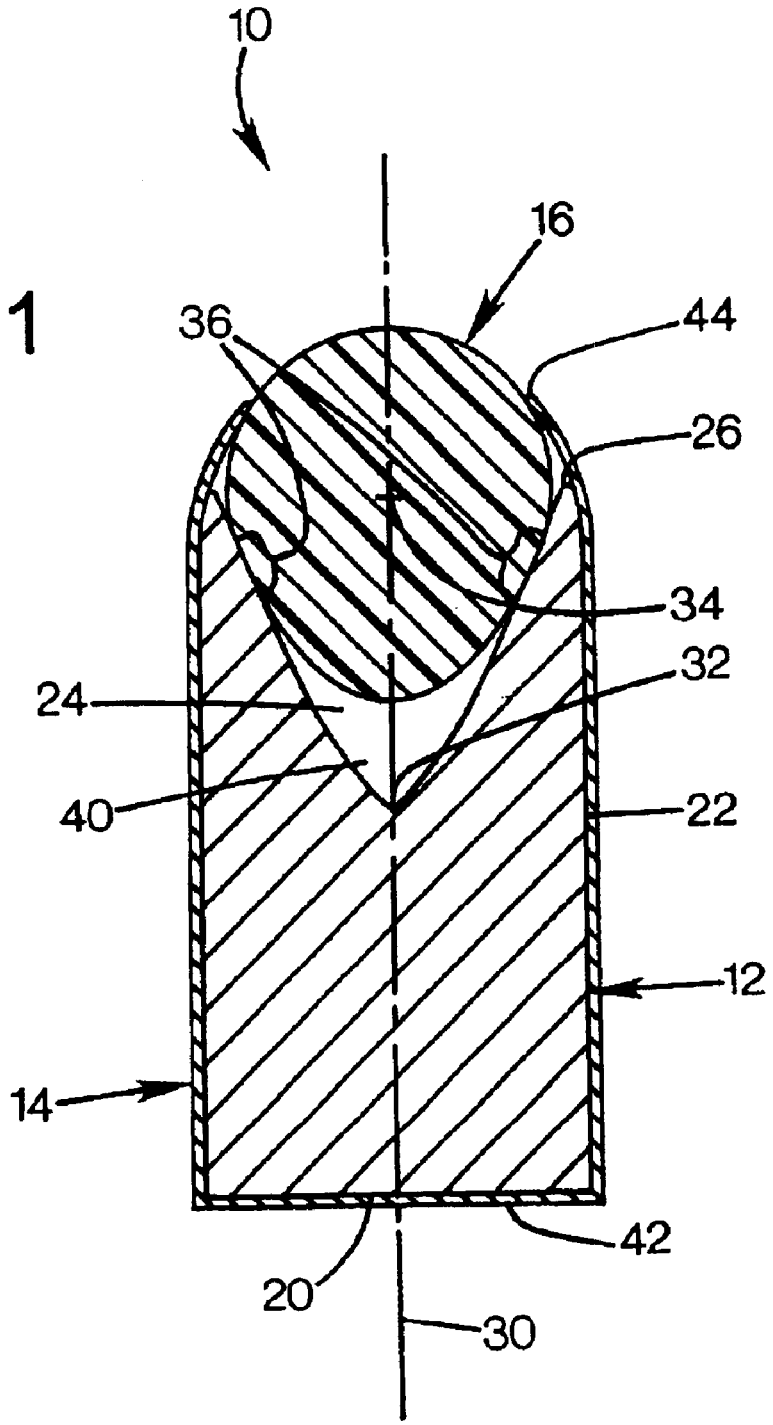
FIG. 1 is a sectional side view of a bullet according to a preferred embodiment of the invention.

FIG. 1 shows a bullet 10 having a lead core 12, a copper jacket 14, and a plastic nose insert or ball 16.

The core is an elongated generally cylindrical element having a flat base 20, straight cylindrical sides 22, and a hollow cavity 24 at a forward end opposite the base. The sides 22 taper slightly inward toward a leading core edge rim 26. The cavity is a generally conical shape extending into the body of the core toward the base. The cavity and core overall are rotationally symmetrical surfaces of revolution about a bullet axis 30. The cavity walls are concave, so that the cone shaped cavity appears to "bulge" somewhat compared to a straight walled cone. The cavity wall surfaces are angled more sharply with respect to the axis 30 near the cavity bottom 32 than they are near the rim 26. In the preferred embodiment, the core has dimensions based upon the caliber of the bullet.

In general, the cavity has a depth approximately 50% of the core length, and this may range from 40% to 60% depending on applications. The cavity depth is approximately 80% of the rim diameter, and this may range from 70% to 100% depending on applications. The core is formed of a malleable, soft, heavy and ductile material such as lead, which readily deforms as will be discussed below. While an alloy of 1% Antimony and 99% lead has proven suitable for some applications, a more pure alloy is preferred to provide greater deformability. A 99.9% pure lead core is preferred, particularly for less powerful calibers where projectile energy is lower than the threshold needed to generate reliable deformation.

The ball 16 is a plastic sphere formed of polypropylene plastic, blended polymer low density polyethylene, or other resilient thermoplastic. It has a smooth, low-friction exterior surface. In alternative embodiments, the ball may be formed of other types of plastic, resin, glass, ceramic, metal or other materials having the desired characteristics. The ball is partially received in the core cavity 24. The ball diameter is slightly less than the rim 26 diameter so that the center 34 of the ball rests slightly below the level of the rim. The ball tangentially contacts the core cavity wall at a circular line or band of contact 36 at an intermediate depth of the wall closer to the rim 26 than to the bottom 32. The bottom of the ball is spaced apart from the cavity bottom, so that a cavity chamber 40 is enclosed by the ball. This chamber has a volume of about 33% of the ball volume, which is about 25% of the cavity diameter.

In alternative embodiments, the ball may be a shape other than spherical, but it is preferably spherical, elliptical, egg-shaped, or any other smoothly curved element. The ball may have other shapes, as long as it defines a chamber with the core cavity, and as long as it presents a smoothly curved exposed nose surface to facilitate feeding and to provide low drag flight ballistics. The preferred ball material has a hardness of Shore-D 45–60, which allows the ball to elastically deform with respect to the lead.

The jacket 14 is a copper layer that covers the entire core, and which partially covers the ball 16. The jacket is generally an open ended cylinder with a base 42 covering the bottom of the core, and a sidewall extending along the sides of the core, and terminating in a lip 44. The lip extends beyond the leading edge 26 of the core and curves inward to an angle tangent with the ball surface. Consequently, the overall bullet shape at the nose is smoothly curved. The jacket rim defines an aperture having a diameter of about 63% of the overall jacket diameter at the base, so that the ball is securely retained. The jacket is scored internally to facilitate "blooming" expansion on impact. In the preferred embodiment, the jacket has a thickness of 0.012+/−0.002.

The bullet provides effective feeding (internal), flight (external), and impact (terminal) ballistics. The rounded overall shape of the jacket and ball feed effectively in auto-loading pistols and carbines, because of the lack of sharp edges that might otherwise generate friction and catch on surfaces such as a feed ramp. The use of low-friction and smooth plastic for the ball further reduces friction and possible wear. The curved shape further ensures low drag flight characteristics, compared to hollow point bullets, yielding higher energy retention at downrange distances.

Upon impact with a targeted attacker, the bullet functions to penetrate several inches without expansion, even in the presence of heavy clothing, and then expand to generate a more incapacitating wound channel and to transfer maximum energy to the target. Upon impact with a target, the bullet initially penetrates effectively in the manner of a solid conventional ball ammunition bullet, even through heavy clothing. In response to the first contact, the ball is momentarily compressed and forced into the chamber 40. In some instances, the ball may deform the core to facilitate expansion. In other instances, the ball absorbs substantially all the deformation needed to be forced into the chamber, without appreciably deforming the core. The ball then elastically springs outward from the cavity, and exits the bullet as the jacket begins to spread open. After departure of the ball, the core behaves as a hollow point bullet, and expands as it passes through fluid or tissue. In tests with ballistic gelatin covered by four layers of 12 ounce denim, it has been observed that the ball delays expansion until after the bullet has penetrated about three inches.

In one example, a 0.45 ACP caliber bullet has a core outside diameter of 0.320 inch, a core length of 0.460 inch, a cavity depth of 0.275, and a rim diameter of 0.424 inch. The core has a weight of 130.5 grains, with the cavity having a volume of 0.04775 cubic inches, which is 25% of the core volume. The ball has a diameter of 0.314 inch.

For another example, a 9 mm parabellum caliber bullet has a core outside diameter of 0.327, a core length of 0.415, a cavity depth of 0.275, and a rim diameter of 0.271. The core has a weight of 90 grains, with the cavity having a volume of 0.0321 cubic inches, which is 21% of the core volume. The ball has a diameter of 0.281.

For another example, a 0.40 S&W or 10 mm caliber bullet has a core outside diameter of 0.380, a core length of 0.434, a cavity depth of 0.215, and a rim diameter of 0.271. The core has a weight of 110 grains, with the cavity having a volume of 0.0358, which is 24% of the core volume. The ball has a diameter of 0.281.

While the above is discussed in terms of preferred and alternative embodiments, the invention is not intended to be so limited.

What is claimed is:

1. A bullet comprising:

a core having a leading end defining a tapered cavity;

the core being formed of a lead alloy;

a jacket surrounding the core;

a nose element in the form of a ball at least partly received within the cavity;

the cavity and the ball enclosing a conical chamber into which the ball may move upon impact with a target;

the nose element being captured by the jacket with a portion of the ball protruding from the jacket, and retained thereby wherein the ball is in the cavity over an initial penetration distance in the target; and the ball being formed of a resilient plastic operable to elastically deform and exit from the core after the initial penetration distance.

2. The bullet of claim 1 wherein the nose element encloses the cavity, and defines an enclosed chamber portion of the cavity.

3. The bullet of claim 1 wherein the cavity has a tapered shape along substantially its entire length.

4. The bullet of claim 1 wherein the core is formed of a lead alloy having at least 99% lead.

5. The bullet of claim 1 wherein the core is formed of lead having at least 99.9% purity.

6. The bullet of claim 1 wherein a major portion of the nose element is received within the jacket.

7. The bullet of claim 1 wherein a front portion of the jacket encompasses a portion of the nose element, and the front portion and an exposed portion of the nose element form a smoothly radiused nose surface.

8. The bullet of claim 1 wherein the nose element and the jacket entirely covers the core.

9. The bullet of claim 1 wherein the jacket defines a front aperture, and wherein the nose element has a diameter greater than the aperture.

10. The bullet of claim 1 wherein the nose element includes an exposed rounded portion.

11. The bullet of claim 1 wherein the core has an overall length of at least 2 times the depth of the cavity.

12. The bullet of claim 1 wherein the core has an overall length of at most 1.5 times the depth of the cavity.

13. The bullet of claim 1 wherein the cavity defines a rim having a rim diameter, and the cavity has a depth less than the rim diameter.

14. The bullet of claim 1 wherein the nose element has a hardness less than that of the core, such that the nose element elastically deforms with respect to the core upon impact.

* * * * *